United States Patent [19]

Roberts

[11] 4,280,550

[45] Jul. 28, 1981

[54] ELECTROSLAG REMELTING FURNACE WITH IMPROVED POWER CONNECTION

[75] Inventor: Raymond J. Roberts, West Berlin, N.J.

[73] Assignee: Consarc Corporation, Rancocas, N.J.

[21] Appl. No.: 120,226

[22] Filed: Feb. 11, 1980

[51] Int. Cl.[3] ..... B22D 23/06; B22D 27/02; H05B 3/60

[52] U.S. Cl. ..... 164/252; 13/9 ES

[58] Field of Search ..... 164/52, 252; 13/9 ES

[56] References Cited

U.S. PATENT DOCUMENTS

| | | | |
|---|---|---|---|
| 3,602,623 | 8/1971 | Wooding | 13/9 ES X |
| 3,610,318 | 10/1971 | Simmons | 164/252 |
| 3,684,001 | 8/1972 | Wooding et al. | 164/252 X |
| 3,744,989 | 7/1973 | Doenecke et al. | 13/9 ES X |
| 3,944,714 | 3/1976 | Shtanko et al. | 13/9 ES |
| 4,049,901 | 9/1977 | Pomeschikov et al. | 13/9 ES |

*Primary Examiner*—Robert D. Baldwin

*Attorney, Agent, or Firm*—Seidel, Gonda, Goldhammer & Panitch

[57] ABSTRACT

An electroslag remelting furnace with a power connection at the base and a coaxial conductor to eliminate the deleterious effects of magnetic fields upon the pool of molten metal. The furnace may have a vertically moveable crucible, and also a top supported inner mold to form a hollow ingot, for containing the molten portions of the metal as the ingot is formed. The upper portions of the annulus between an inner and outer mold can be greater in width than the width of the lower portion of the annulus to permit increased spacing between the electrodes and the walls of the molds or to permit the use of electrodes of a larger diameter than the width of the lower portion of the annulus.

8 Claims, 4 Drawing Figures

24
18
55
57
30
58
22
60
16
20
36
34
26
32
10
54
56
12
40
28
40
42
44
48
50
46
52
14
38

24'
18'
22'
55'
57'
30'
58'
60'
16'
20'
36'
34'
12'
26'
10'
72
32'
56'
54'
66
64
42'
68
44'
62
28'
46'
48'
50'
52'
70
14
38'

24'
18'
57'
55'
30'
58'
22'
60'
16'
20'
36'
88
34'
10'
56'
12'
26'
72'
54'
32'
66'
86
42'
68'
64'
82
87
42'
44'
80
82
84
44'
28'
46'
48'
50'
52'
70'
38'

ELECTROSLAG REMELTING FURNACE WITH IMPROVED POWER CONNECTION

This invention relates to an electric power connection for an electroslag remelting furnace. More particularly this invention relates to an electric power connection which eliminates the deleterious effects of the accompanying electromagnetic fields in the high current draped electrical cables, thus permitting a reduction in the overall height of the furnace.

The elimination of stirring in the pool of molten metal caused by the magnetic field generated by the current flow in an electroslag remelting furnace is described in detail in U.S. Pat. No. 3,684,001. The elimination of such magnetic field effects was achieved by providing the furnace with a power connection equivalent to a coaxial conductor. Such a connection was accomplished by providing a return conductor extending vertically from the base of the crucible coaxially upward and surrounding the power connection to the electrode, the molten slag pool, the molten metal pool, and the remelted ingot so as to define a coaxial configuration. The coaxial configuration continued to a point sufficiently above the molten slag pool and the molten metal pool so that any vertical components of the magnetic field which are generated in the melt zone by the flexible conductors used to make the electrical connection between the coaxial configuration and the electrical power supply will have minimal effects on the ingot.

Although the coaxial power connection has been a great improvement over prior power connections, the draped flexible conductor cables may still generate sufficient vertical components of a magnetic field to have some effect upon the molten metal in the melt zone. Therefore it has been necessary to keep these cables sufficiently distant from the melt zone so as to not effect the formation of the ingot by the generated magnetic field. This necessitated that the furnace be of a sufficient height to permit such spacing between the power conductor cables and the melt zone.

The present invention is directed to providing an electroslag remelting furnace for use with a power connection so as to eliminate the effect of the magnetic field of the draped flexible power connection cables on the formation of the metal ingot.

The present invention is also directed to providing an electroslag remelting furnace having a reduced overall height resulting from the elimination of the draped flexible power conductor cables.

The present invention is further directed to reducing the height of the furnace by eliminating the conductor and hydraulic positioning means which extend considerably upward from the top of the electrode constituting a substantial portion of the overall height of the furnace disclosed in U.S. Pat. No. 3,684,001.

The objects and advantages of the present invention are achieved by providing an electroslag remelting furnace with a power connection through its base. This is accomplished by connecting the electric power terminals at the base of the furnace. One terminal is connected to a discrete number of individual conductors, preferably equally spaced around the perimeter of a crucible, extending coaxially upward and surrounding a return conductor path. The return conductor path includes the power connection to the electrode, the electrode, the molten slag pool, the molten metal pool, the ingot and the baseplate to which another power terminal is connected. This configuration eliminates any magnetic effects on the melt zone which would be generated by the draped flexible high current electrical conductors presently used to make the power connection between the furnace and the electrical power supply.

In U.S. Pat. No. 3,684,001, the rotational arrangement of the furnace head 22 and the requirement that the head be able to move vertically necessitate the use of flexible electrical cables 90 of sufficient capacity to carry the full melting current. Such cables must, of necessity, be of limited cross sectional area if they are to be adequately flexible and are to fit in the limited spaces mormally available. Therefore, a significant amount to electrical energy is dissipated by these cables. The improved furnace of this disclosure uses no such cables, thus making the furnace more efficcient than the furnace disclosed in U.S. Pat. No. 3,684,001 due to decreased energy loss in the fixed conductors. Thus, the present invention is further directed to providing an electroslag furnace of improved efficiency.

For the purpose of illustrating the invention, there is shown in the drawings a form which is presently preferred; it being understood, however, that this invention is not limited to the precise arrangements and instrumentality shown.

The present invention is best understood by referring to the drawings wherein like numerals designate like elements.

Figure 1:
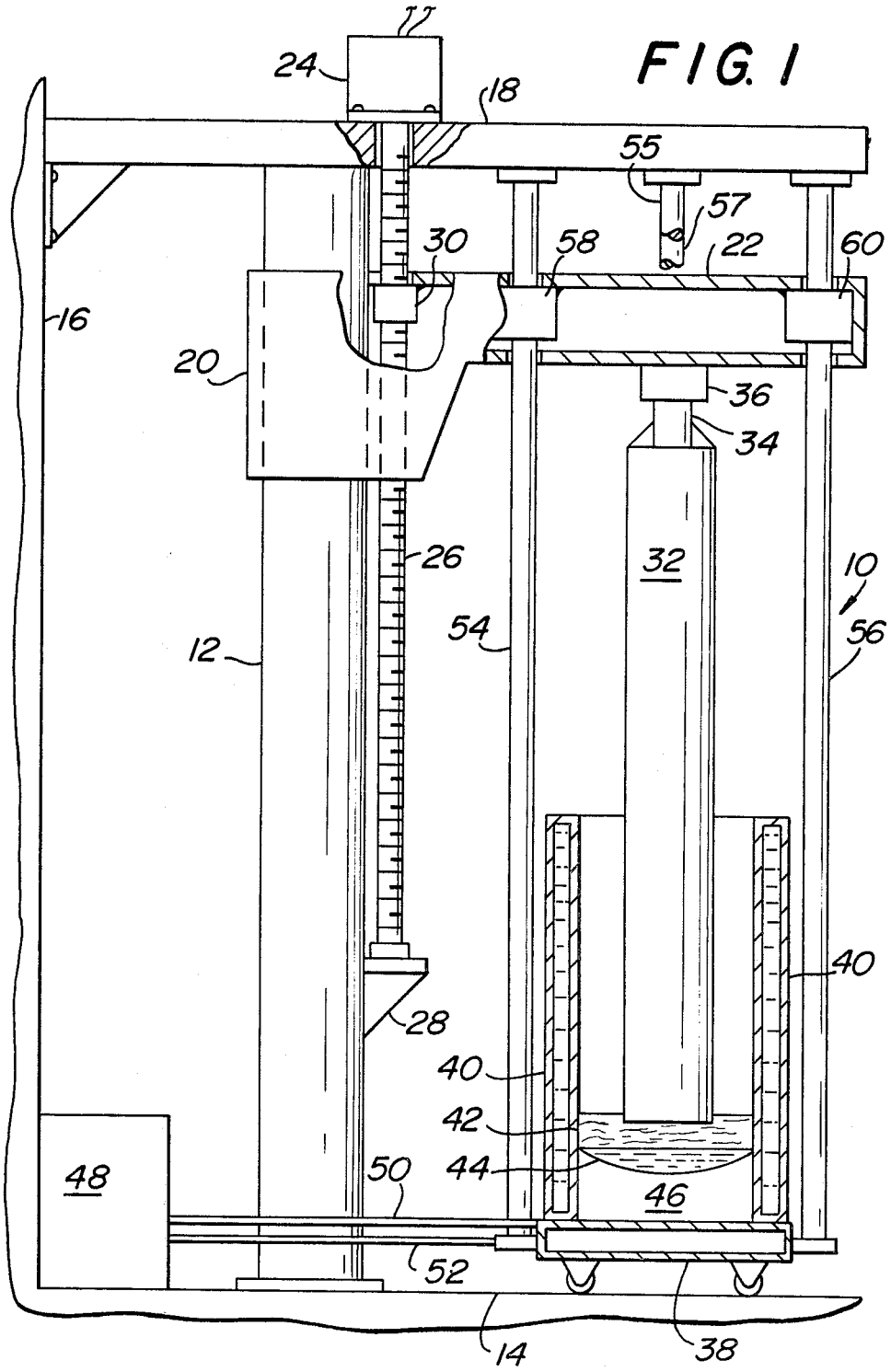
FIG. 1 is a partial sectional view of the side elevation of the furnace showing the guide arm supporting an electrode and a partially formed ingot within the furnace.

There is shown in FIG. 1 a consumable electrode furnace of the electroslag remelting type designated generally as 10. The furnace 10 has been greatly simplified for purposes of describing this invention. What is shown is an electroslag remelting furnace having a generally vertical support 12 which stands on a floor 14 and may be conveniently braced to an adjacent wall or other suitable support structure 16 by means of a support member or strut 18.

Mounted on support 12 is a vertically slidable guide arm 20 supporting a furnace head 22. A drive mechanism 24 raises and lowers guide arm 20 and furnace head 22 by rotating a threaded shaft 26. The threaded shaft 26 is housed at one end in the device mechanism 24 and supported at the other end by bracket 28. The threaded shaft 26 is cooperatively associated with a nut 30 housed within guide arm 20 so that rotation of the threaded shaft 26 by the drive mechanism 24 produces upward or downward movement of the guide arm 20 and furnace head 22 along support 12.

A remeltable metal electrode 32 is attached by stub 34 which is welded to electrode 32, and clamp 36 which supports stub 34 in furnace head 22. A carriage mounted fluid cooled baseplate 38 supports a fluid cooled crucible 40 in which the electrode 32 is disposed. A molten slag pool 42, a molten metal pool 44 and an ingot in process of formation 46 are also shown.

An electrical connection system from a source of electrical power 48 is connected to the baseplate 38 by a conductor 50. A second conductor 52 connects the source of electrical power 48 to a plurality of vertical conductors 54, 55, 56 and 57, which are preferably equally spaced around the outside of crucible 40 to form the requisite equivalent of a coaxial conductor. Conductors 55 and 57 are shown cut away for ease in understanding the drawing and to properly show the placement of the electrode 32, the stub 34 and the clamp 36. These vertical conductors 54–57 extend upwardly through a plurality of sliding electrical contacts 58 and 60 mounted in the furnace head 22. Since all of these conductors are fixed, they can be made large enough to conduct current without significant energy loss.

The sliding contacts 58, 60 are electrically connected to the furnace head 22 and also to clamp 36 so that a complete electrical circuit is formed by conductors 52, 54–57, sliding contacts 58 and 60, furnace head 22, clamp 36, stub 34, electrode 32, molten slag pool 42, molten metal pool 44, ingot 46, baseplate 38 and conductor 50.

Conductors 50 and 52 are connected to power supply 48 which may be any of the transformer, thyrister, saturable reactor, or other power supply units well-known in the art. The conductors 50 and 52 may pass either adjacent to or through the base of support 12.

In the illustrated embodiment the drive mechanism 24 is disposed above the support member 18. However, to save further height, the drive member could be relocated to the bottom of the threaded shaft 26 at the base of column 12.

Electrodes, crucibles and ingots can move under or away from furnace head 22, as required, by the horizontal movement of baseplate 38. The positioning of the vertical conductors 54–57 should preferably leave an opening large enough to provide for such motion. If, however, an opening is not so provided, one or more of the conductors 54–57 may be repositioned temporarily to allow for such movement.

Figure 2:
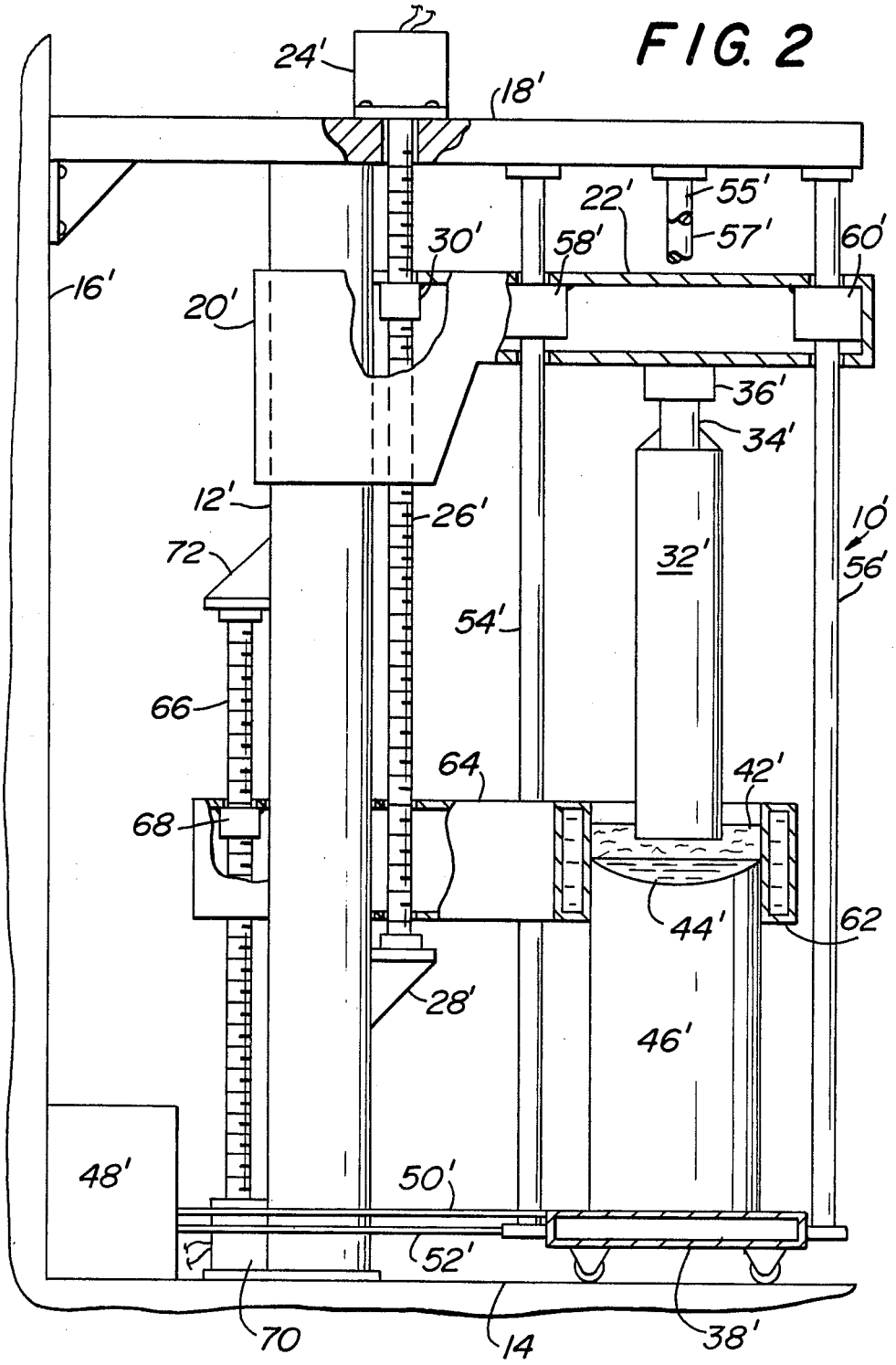
FIG. 2 is a partial sectional view of a side elevation of a second embodiment of the furnace showing an upwardly driven crucible.

FIG. 2 shows a second embodiment of the electroslag remelting furnace designed to remelt the metal electrode using an upwardly driven crucible. Elements which are the same as those shown in FIG. 1 are identified by the same numeral with a prime notation. The drawing shows a vertically moveable crucible 62 supported by arm 64 which is moved by the threaded shaft 66 in engagement with nut 68 housed within the support arm 64. The threaded shaft 66 is housed at one end by a drive mechanism 70 located at the bottom of the threaded shaft 66 immediately adjacent to support 12' and supported at the end by bracket 72.

The drive mechanism 70 is controlled in such a manner that, in cooperation with the threaded shaft 66 and nut 68, it raises support arm 64 and crucible 62 vertically so as to continue to contain the molten slag pool 42' and molten metal pool 44' as the remelted metal ingot 46' is formed. The raising of the support arm 64 and crucible 62 depend entirely on the time required for the metal electrode 32' to melt, pass through the molten slag pool 42' to the molten metal pool 44' and cool to form the metal ingot 46'.

If it is desirable to make an ingot from a plurality of short electrodes, this can be accomplished by the addition of two manipulating devices. The first such device is used to remove the spent electrode remnant and its attached stub 34 from clamp 36. The other manipulating device is used to insert a new electrode into the clamp. These devices would preferably be mounted either adjacent to or on support 12 and arranged to insert and remove electrodes through suitable spaces between the vertical conductors 54–57. Such types of manipulators are known in the materials handling art and are therefore not described here.

Figure 3:
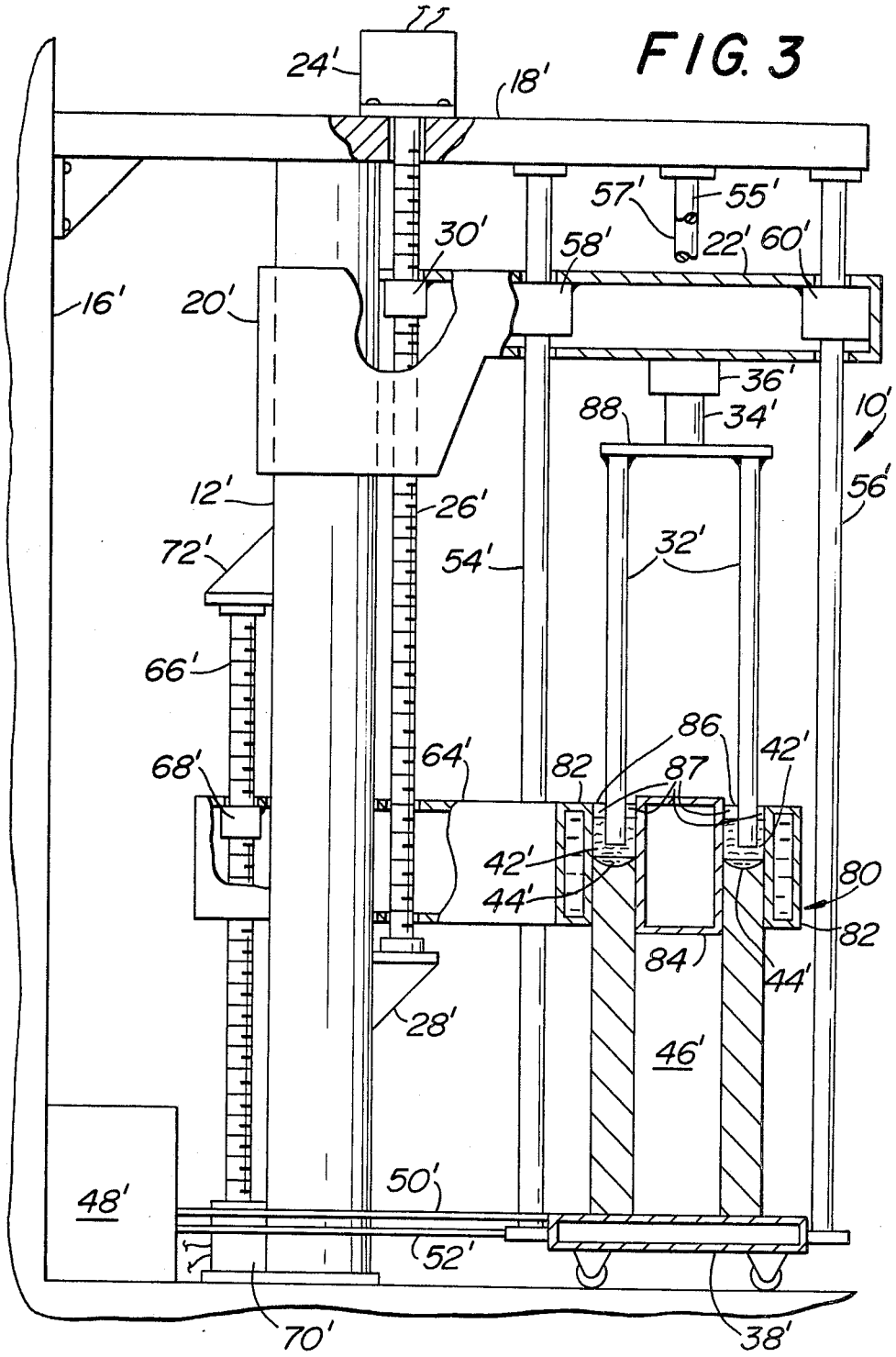
FIG. 3 is a partial sectional view of a side elevation of a third embodiment of the furnace showing a plurality of electrodes and an upwardly driven crucible for forming hollow ingots.

FIG. 3 shows a third embodiment of the electroslag remelting furnace wherein a plurality of electrodes are remelted using an upwardly driven crucible, as shown and described in FIG. 2, or the type which forms hollow ingots. Elements which are the same as those shown in FIGS. 1 and 2 are identified by the same numeral with a prime notation. A crucible generally designated 80 is supported by arm 64'. The crucible 80 has an outer mold section 82 and an inner mold section 84 where the inner section 84 is top supported from the outer section 82. The top supports 86 are arranged so as to extend between a plurality of vertical electrodes 32'. The top supports 86 can be used to convey cooling fluid to the inner section of the mold assembly 84. The electrodes 32' are attached by welding or another similar manner to the carrier plate 88 which is supported by stub 34' and clamp 36' which is connected to furnace head 22'.

The configuration of crucible 80, specifically the relationship between the outer section 82 and the inner section 84, forms an annular or similar hollow gap 87. The remelting of the electrodes 32' using the crucible 80 as generally described above, will result in the formation of a hollow ingot 46'.

Figure 4:
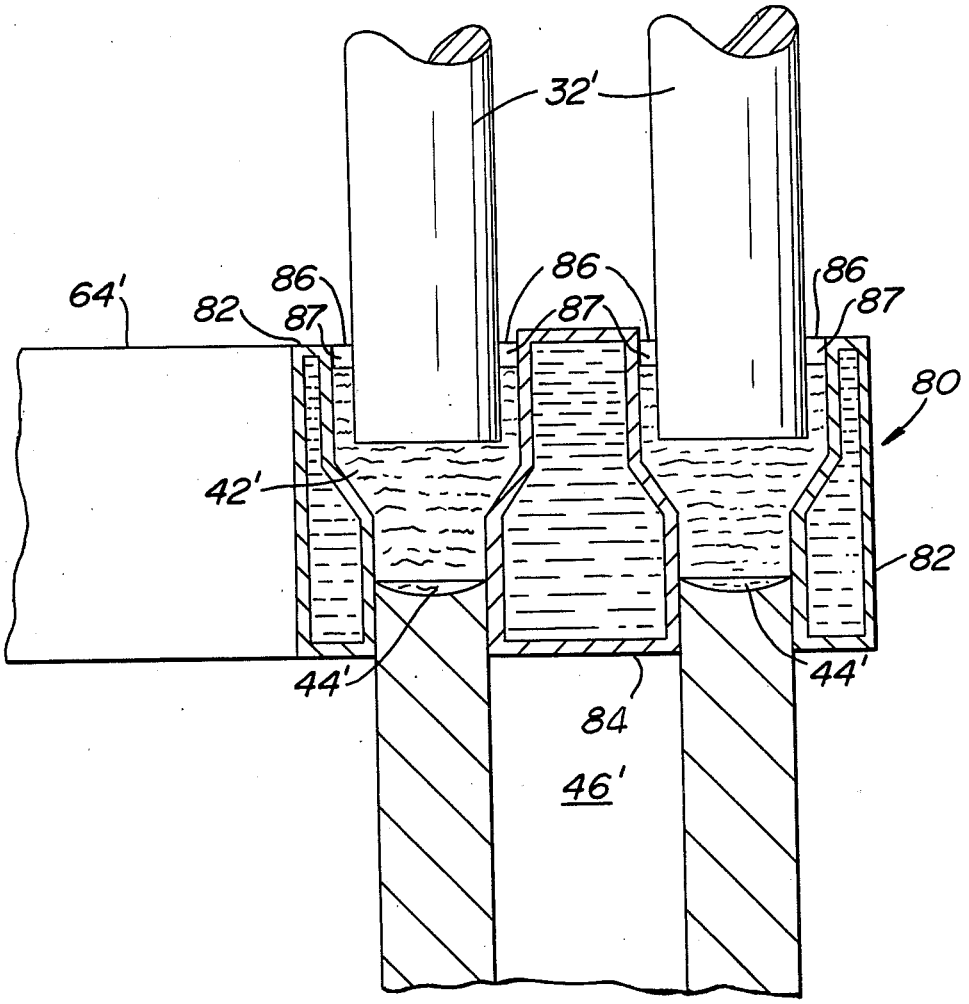
FIG. 4 is a partial sectional view of a side elevation of a crucible showing a wider annulus or gap in the upper portion of the crucible to accomodate larger diameter electrodes or to increase the spacing between the electrodes and the walls of the upper portion of the crucible.

In order to increase the length of an ingot capable of being made by the furnace without excessive increases in the length of the electrodes, the electrodes 32' can be increased in diameter, thus requiring the crucible 80 to have a larger annular gap 87 between the inner mold section 84 and/or the outer mold section 82 as shown in FIG. 4. The upper portions of the inner mold section 84 and/or the outer mold section 82 will necessarily be reduced in size to accomodate larger diameter electrodes. This would increase the upper portion of the gap 87 between the outer mold section 82 and the inner mold section 84 of the crucible 80.

In comparison to the electroslag furnace currently in use, the present invention is of a lesser overall height due to the elimination of the rotational arrangement of the furnace head. It was also necessary, due to the rotational motion of the head and the requirement that the head be able to move vertically, to make electrical connectors which were flexible. These electrical cables had to be of sufficient capacity to carry the full melting current and still be adequately flexible and able to fit into a limited space. These requirements restricted the cables to a limited cross-sectional area resulting in a significant amount of dissipation of electrical energy. Additionally, the draping of the cables to accomodate the rotational arrangement and vertical movement of the furnace head created a magnetic flux which had an adverse effect on the formation of the remelted ingot if they are not separated from the melting zone by a sufficient distance.

The improved electroslag remelting furnace of this disclosure eliminates the requirement of flexible electrical connection cable drapes above the furnace head by applying the power connection at the base of the furnace. Thus, eliminating the adverse effect of the magnetic flux of the cable drapes in the formation of the remelted ingot and reducing the overall height of the furnace. Additionally, the improved electroslag remelting furnace has been made more efficient by reducing the energy loss with the elimination of the flexible power connectors.

The present invention may be embodied in other specific forms without departing from the spirit or essential attributes thereof and, accordingly, reference should be made to the appended claims, rather than to the foregoing specification as indicating the scope of the invention.

I claim:

1. A power connection for an electroslag remelting furnace, said electroslag remelting furnace comprising a crucible supported upon an electrically conductive base, a vertically adjustable electrode support means for supporting one or more electrodes within said crucible for forming an ingot therein, a plurality of individual rigid conductors spaced around the periphery of the crucible and base, and extending vertically from said base to said electrode support means, said individual conductors defining a vertical coaxial configuration for eliminating the effects of magnetic fields upon an ingot being formed within the crucible, and power conductors for connecting a source of electrical power to said furnace, said electrode support means including contact means for maintaining it in continuous electrical contact with said individual conductors regardless of its vertical position relative to the base whereby electrical power may be conducted from said individual conductors to one or more electrodes supported by said electrode support means, one of said power conductors being connected to said base and the other of said power conductors being connected to individual conductors at a position adjacent to said base, whereby an electric circuit may be defined by said power conductor connected to said individual conductors, said electrode support, the one or more electrodes supported thereon, a slag and molten metal pool contained within said crucible, any ingot formed within said crucible, said base, and the one of said power conductors which is connected to said base.

2. The furnace in accordance with claim 1 wherein said adjustable electrode support means includes a vertical support, an arm extending from said vertical support having a plurality of slidable electrical contactors for conveying power from said individual conductors to said one or more electrodes and a vertical displacement means to raise or lower said arm in the operation of said furnace.

3. The furnace in accordance with claim 2 wherein said vertical displacement means includes a drive for operating a threaded shaft and nut in relative rotation to each other to raise and lower said arm in the operation of said furnace.

4. The furnace in accordance with claim 1 wherein said crucible has openings at both ends, said crucible being supported by a second adjustable support means arranged to move said crucible vertically to contain at least the slag and the molten portion of said ingot while said ingot is being formed.

5. The furnace in accordance with claim 4 wherein said second adjustable support means includes an arm extending from a vertical support connecting with a second vertical displacement means, said second vertical displacement means including a drive means for operating a threaded shaft and a nut in relative rotation to each other to raise and lower said arm in the operation of said furnace.

6. The furnace in accordance with claim 4 wherein said crucible includes an outer mold disposed around an inner mold to form an annular gap between said inner and outer molds for the formation of a hollow ingot, said second support means extending from adjacent the top of the said outer mold to adjacent the top of said inner mold to retain said inner mold in fixed relationship to said outer mold.

7. The furnace in accordance with claim 6 wherein the width of an upper portion of the annulus between said inner and outer molds is greater than the width of a lower portion of an annulus to permit the use of one or more electrodes of a diameter larger than the width of said lower portion of the annulus.

8. The furnace in accordance with claim 6 wherein the width of an upper portion of the annulus between said inner and outer molds is greater than the width of a lower portion of the annulus to permit an increase in spacing between said one or more electrodes and the walls of said upper portion of said inner and outer molds.

* * * * *